US006223538B1

(12) United States Patent
Benz et al.

(10) Patent No.: US 6,223,538 B1
(45) Date of Patent: May 1, 2001

(54) CERAMIC LINING

(75) Inventors: Urs Benz, Gipf-Oberfrick (CH); Armin Heger, Scottsdale, AZ (US); Marcel König, Wettingen (CH); Axel Kranzmann, Stuttgart; Andreas Pfeiffer, Lauchringen, both of (DE); Roger Suter, Zürich; Hugo Wetter, Buchs, both of (CH)

(73) Assignee: Asea Brown Boveri AG, Baden (SE)

( * ) Notice: Subject to any disclaimer, the term of this patent is extended or adjusted under 35 U.S.C. 154(b) by 0 days.

(21) Appl. No.: 09/442,480

(22) Filed: Nov. 18, 1999

(30) Foreign Application Priority Data

Nov. 30, 1998 (EP) ..... 98 811 182

(51) Int. Cl.[7] ..... F02C 3/00
(52) U.S. Cl. ..... 60/753
(58) Field of Search ..... 60/753; 431/353

(56) References Cited

U.S. PATENT DOCUMENTS

| | | | | |
|---|---|---|---|---|
| 2,919,549 | | 1/1960 | Haworth et al. . | |
| 4,569,659 | | 2/1986 | Olsen et al. . | |
| 5,331,816 | * | 7/1994 | Able et al. | 60/753 |
| 5,553,455 | * | 9/1996 | Craig et al. | 60/753 |
| 5,624,256 | | 4/1997 | Pfeiffer et al. . | |
| 5,957,067 | * | 9/1999 | Döbbeling et al. | 110/336 |
| 6,085,515 | * | 7/2000 | Walz et al. | 60/753 X |

FOREIGN PATENT DOCUMENTS

| | | |
|---|---|---|
| 19 22 679 | 11/1970 | (DE) . |
| 36 25 056 | 1/1988 | (DE) . |
| 195 02 730 | 8/1996 | (DE) . |
| 0 224 817 | 6/1987 | (EP) . |
| 0 658 724 | 6/1995 | (EP) . |
| 783521 | 9/1957 | (GB) . |
| 1121991 | 7/1968 | (GB) . |

* cited by examiner

*Primary Examiner*—Charles G. Freay
*Assistant Examiner*—David J. Torrente
(74) *Attorney, Agent, or Firm*—Burns, Doane, Swecker & Mathis, L.L.P.

(57) ABSTRACT

The invention relates to a ceramic lining for combustion chambers (8) consisting of several juxtaposed elements (1) that are attached by means of a retention bolt (3) to the inside of a thermally highly stressed metallic support wall (4), whereby at least one insulation body (5) is arranged between the metallic support wall (4) and the ceramic elements (1). It is characterized in that the ceramic elements (1) essentially have the shape of a straight, regular pyramid whose base (2) has n corners, preferably three corners, and faces the combustion chamber (8), and into whose tip the retention bolt (3) is integrated.

11 Claims, 3 Drawing Sheets

CERAMIC LINING

BACKGROUND OF THE INVENTION

1. Field of the Invention

The invention relates to a ceramic lining for thermally highly-stressed walls of combustion chambers. Such linings are used in particular as an internal wall insulation of metallic combustion chambers, for example for gas turbines.

2. Brief Description of the Related Art

Combustion chamber walls may be designed with polygonal surface elements of ceramic material or metal. The number of corners of these elements is usually 3 or 4. But hexagonal surface elements are also known. These surface elements are structured like a plate and are attached to the metallic support structure with a separate bolt.

DE 195 02 730 A1 describes, for example, a ceramic lining of a combustion chamber consisting of at least one wall plate of high-temperature-resistant structural ceramic, also called monolithic ceramic, with at least one continuous opening and one attachment element per opening. The attachment element is attached by its foot in a metallic retention device provided on a metallic support wall, whereby the head of the attachment element rests in the opening of the wall plate. The attachment element also consists of high-temperature-resistant structural ceramic and is connected spring-elastically to the retention device. An insulation layer of fiber ceramic is provided between the metal wall and the ceramic wall plate.

The advantages of this solution are that the lining can be uninstalled without destroying it and therefore can be used several times. The spring-elastic connection of the ceramic structure with the metallic retention construction furthermore makes it possible for the thermal expansions between metallic and ceramic components or deformations of the insulation layer through mechanical stresses to be absorbed.

These advantages are counteracted by the disadvantages that the attachment of the lining on the metallic support structure is relatively complex because of the separate bolt and retention device, and that the lining is complicated because it requires several layers.

Because of the plate structure, the insulation layer on the side facing away from the hot gas also must be constructed from plates in a ceramic design of the combustion chamber. The usually porous structure of the insulating material makes the insulation plates sensitive to vibrations, which may cause a breaking of the parts. It is also necessary that retainers for the insulation are provided.

In addition, the hot-gas-conducting, plate-shaped combustion chamber tiles are also very sensitive to vibrations and damage due to foreign parts, since the plates are very thin and fragile.

SUMMARY OF THE INVENTION

The invention attempts to avoid these disadvantages. It is based on the objective of developing a ceramic lining for combustion chambers that is resistant to vibrations and large temperature gradients, that is easy to manufacture, and that does not require any additional retainers for the insulation.

According to the invention, this is achieved for a ceramic lining in that the ceramic elements essentially have the shape of a straight, regular pyramid whose base has n corners and faces the combustion chamber, and into whose tip the retention bolt is integrated.

The advantages of the invention are that, as a consequence of the voluminous construction of the ceramic elements, a functionally favorable shape is achieved. Large, hot surfaces of the ceramic element continuously change into the retention bolt, so that the heat is continuously dissipated from the hot surface into the (cooled) bolt. This reduces rough changes between cross-sections that would have an unfavorable effect on the tensions in the component. The integrated retention bolt makes the ceramic elements resistant to vibrations and temperature gradients, so that they do not break. In addition, the shaped elements are easy to manufacture. Because of their shapability on all sides during the molding of the blanks, it is possible to achieve a good degree of compacting.

It is useful that the hollow spaces formed by the ceramic elements with their surfaces facing away from the combustion chamber are filled with insulation bodies that are form-fitted between the ceramic elements on the one side and the metallic support structure on the other side. This shields the metallic support structure especially well from the high temperatures of the combustion chamber. This form-fitting is also advantageous because it eliminates the need for additional retainers for the insulation bodies.

In one embodiment it is furthermore advantageous if the hollow spaces formed by the ceramic elements with their surfaces facing away from the combustion chamber, i.e., the hot gas side, are filled with air. This is a very cost-effective embodiment since cheap air functions in this case as insulation material.

It is also useful if the ceramic elements have a triangular base, preferably a tetrahedral shape. This shape is the one that can be manufactured most efficiently, and because of the stout shape of the ceramic elements a good degree of compaction is achieved.

It is finally also advantageous that the ceramic elements are pressed along with the insulation bodies using elastic elements, preferably plate springs, cylindrical pressure springs or corrugated metal sheets against the metallic support structure, or the insulation bodies are pressed by means of elastic elements against the ceramic elements. This makes additional retainers for the insulation superfluous, reduces cooling air leakage, and achieves a dampening of vibrations. The latter is also accomplished with an elastically positioned retention bolt. The spring-elastic connection of the ceramic structure or insulation material absorbs the thermal expansions between the various components and the deformations of the insulation material due to mechanical stresses.

It is furthermore possible to construct the surfaces of the ceramic elements and insulation bodies in convex or concave shape. This has the advantage that curvatures in the combustion chamber wall can be followed, permitting an optimum lining.

It is furthermore useful if the base of the ceramic elements, which forms the hot gas side, is provided with thermal insulation layers or abrasion-resistant layers. This is a good option if instead of monolithic ceramic a less resistant but cheaper base material is used for the element. This also permits a stable lining of the combustion chamber that is resistant to vibration and high temperatures.

BRIEF DESCRIPTION OF THE DRAWINGS

The drawing shows several exemplary embodiments of the invention in reference to a thermally highly-stressed gas turbine combustion chamber.

Shown are in.

Only those elements necessary for understanding the invention have been shown.

DESCRIPTION OF THE PREFERRED EMBODIMENTS

The following explains the invention in more detail in reference to exemplary embodiments and FIGS. 1 to 6.

Figure 1:
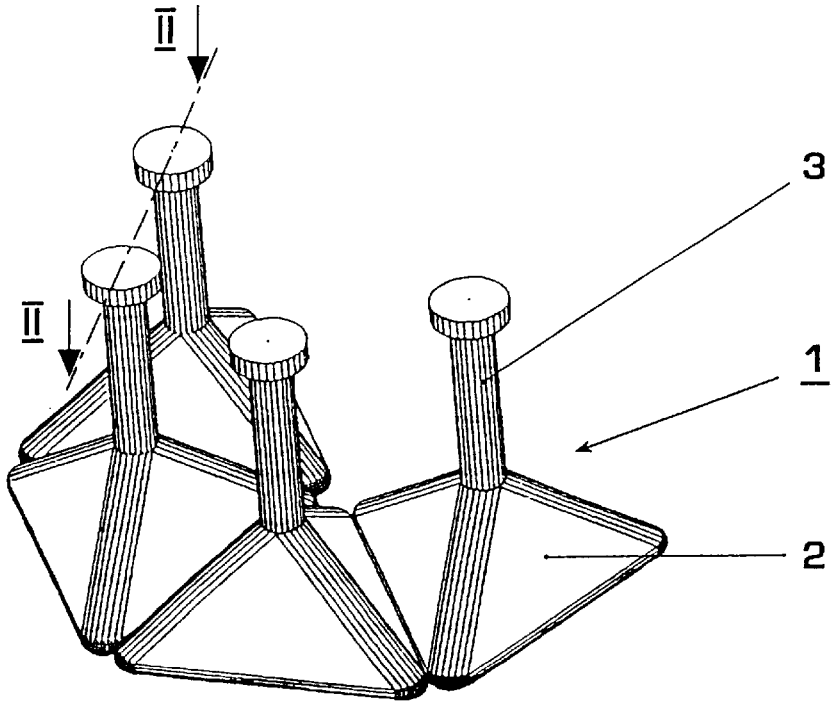
FIG. 1 a perspective view of several juxtaposed ceramic elements in a first embodiment of the invention.

FIG. 1 shows a perspective view of several juxtaposed ceramic elements 1 of a ceramic lining of a gas turbine combustion chamber (not shown). The ceramic elements 1 in this exemplary embodiment essentially have the shape of a tetrahedron. This means they have a base 2 with a number n of corners, whereby in this case n=3. The three sides of the base 2 are equally long. At the tip of each element 1, i.e., here at the tip of the tetrahedron, a retention bolt 3 is arranged that is integrated into the tetrahedron. Each ceramic element 1 therefore consists of the tetrahedron, including the retention bolt 3. The tetrahedral shape is very advantageous in respect to manufacturing. Because of the shapability on all sides during the molding of the blanks, a good degree of compaction is achieved. But the tetrahedron shape also permits a favorable shape in respect to function. The large hot surfaces of the tetrahedron continuously change into the retention bolt 3. In respect to tension, this is very favorable so that the combustion chamber tile is resistant to vibrations and temperature gradients and therefore its breaking probability is very low.

Figure 2:
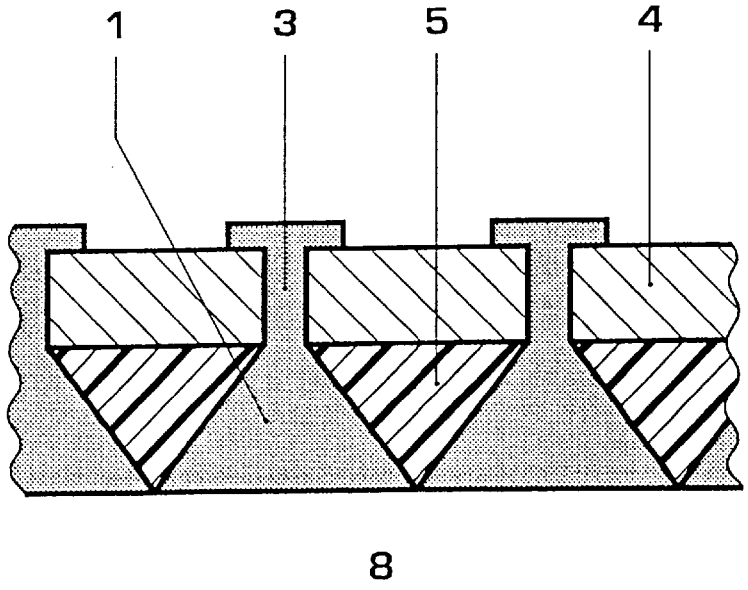
FIG. 2 a longitudinal section along line II—II in FIG. 1, whereby the metallic support structure is also shown.

FIG. 2 shows a section along line II—II in FIG. 1. FIG. 2 shows that the ceramic elements 1 each are connected with their retention bolt 3 on the metallic support wall 4 of the combustion chamber. The spaces between the support wall 4 and the ceramic elements 1 are filled with insulation material 5. In the simplest case, air can be used as an insulation material 5. But insulation bodies 5 of, e.g., $Al_2O_3$, $ZrO_2$, foams, or alloys of both oxides, as well as reticular ceramic from both oxides or alloys, as well as insulating stones of oxide ceramic, in particular of the mentioned oxides, have a better insulating effect.

Figure 3:
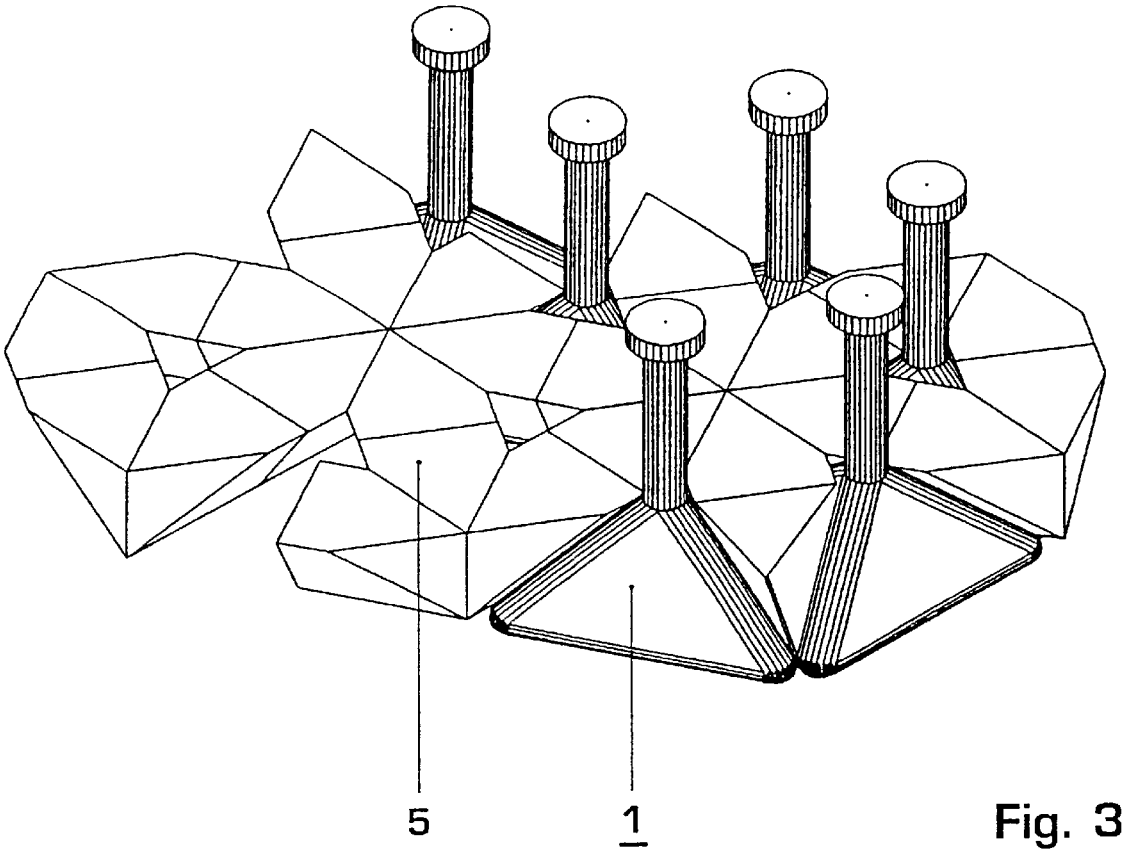
FIG. 3 a perspective view of several juxtaposed ceramic elements with insulation bodies in the hollow spaces between the ceramic elements.
Figure 5:
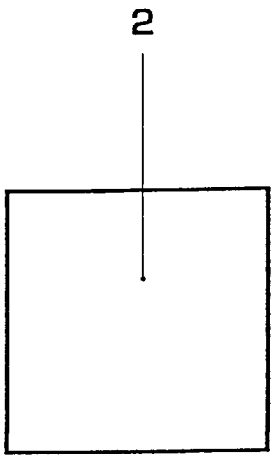
FIG. 5 a top view of the base of a ceramic element in a second embodiment of the invention.

FIG. 3 shows a perspective view of the arrangement of insulation bodies 5 in the spaces between the ceramic elements 1. There is a form-fitting connection between the insulation points 5 and the ceramic elements 1. This makes separate retainers for the insulation superfluous.

Figure 4:
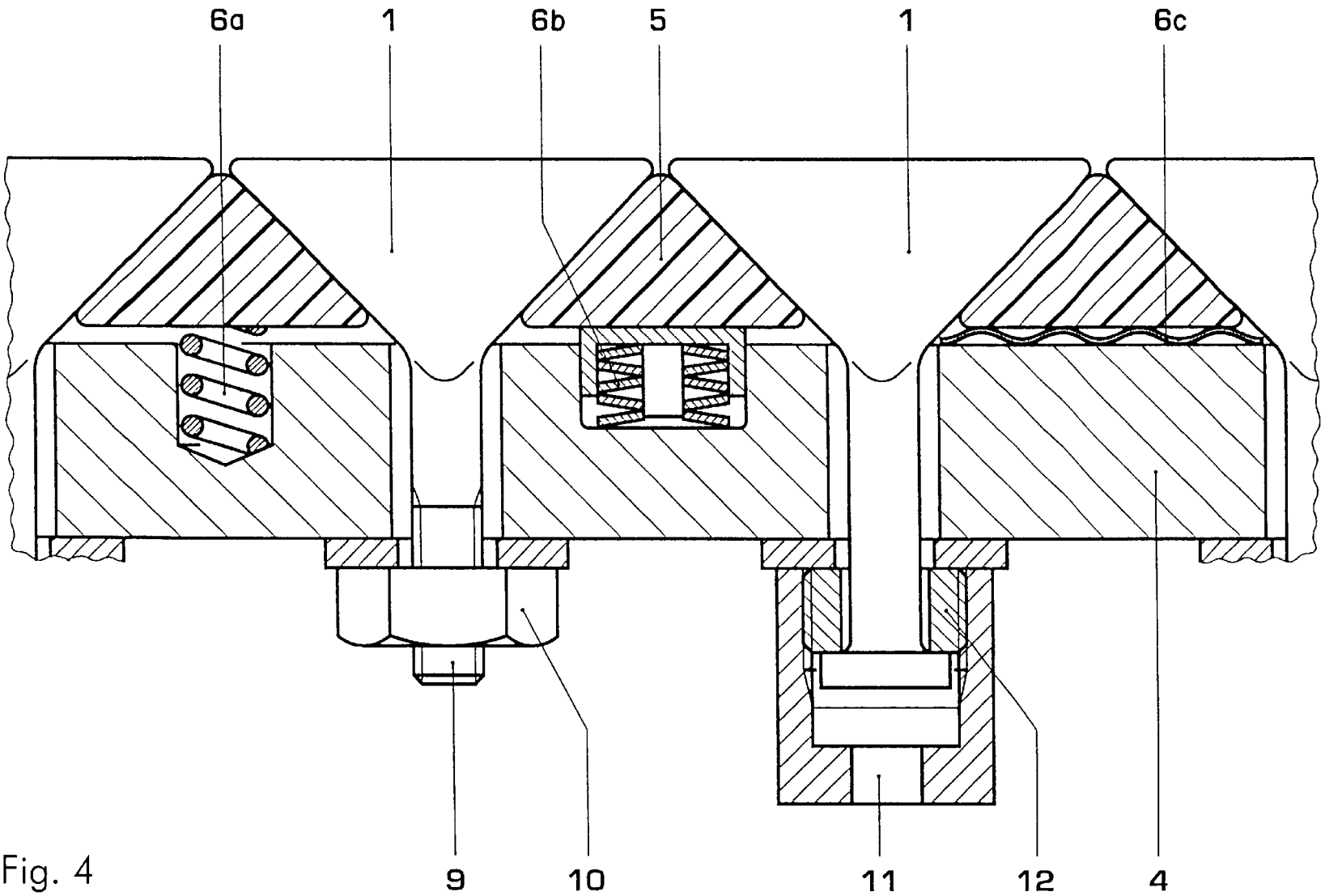
FIG. 4 a partial longitudinal section with various elastic elements for pressing the insulation to the ceramic elements.

FIG. 4 shows variations of how the insulation 5 can be elastically connected. It shows that between the metallic support structure 4 and insulation 5 elastic elements 6 are arranged which press the insulation 5 against the ceramic elements and in this way prevent cooling air leaks and dampen the vibration. The elastic elements 6 hereby may be, for example, cylindrical pressure springs (left part of FIG. 4), plate springs (center of FIG. 4), or corrugated sheet metal (right part of FIG. 4). FIG. 4 also shows two possible attachment variations for the combustion chamber tile (ceramic element 1) on the support wall 4. The left part of FIG. 4 shows that the retention bolt 3 is provided with a thread 9 onto which a nut 10 has been screwed, while the right part of FIG. 4 shows the attachment of the retention bolt 3 and therefore of the ceramic element 1 on the support wall 4 using a threaded bushing 11 and a two-part threaded insert 12.

In other exemplary embodiments, the ceramic elements 1 also can be pressed along with the insulation 5 against the support structure 4 via elastic elements 6. This results in the same advantages. With suitable insulation material, the insulation 5 also could function as a spring element 6 itself.

Figure 6:
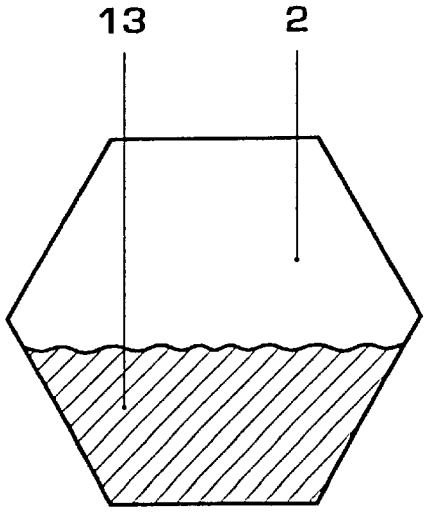
FIG. 6 a top view of the base of a ceramic element in a third embodiment of the invention.

In addition to the above described tetrahedral elements 1, pyramid-shaped elements with a base 2 with four corners (FIG. 5) or six corners (FIG. 6), for example, also can be used as ceramic linings. FIG. 6 indicates that the base 2 facing the hot gas side can be provided with special thermal insulation layers or abrasion-resistant layers 13. This is recommended if lower quality base material is used so that it then will be able to withstand higher thermal and mechanical stress. Suitable layers include, for example, layers from reticular structures, but also short-glass-fiber-reinforced layers, sprayed layers, chemically precipitated layers, as well as sol-gel or layers precipitated from the gaseous or liquid phase.

A suitable material for the ceramic elements 1 is primarily monolithic ceramic, either sintered or bound by reaction. Fiber-reinforced ceramic is suitable also.

The invention naturally is not limited to the above described exemplary embodiments. For example, the retention bolt 3 can be positioned elastically, or ceramic elements 1 with another pyramid-shaped body than that described above can be used as a lining of the combustion chamber. The ceramic elements 1, for example, may have tetrahedral surfaces with a convex or concave curvature, which is advantageous because this is able to compensate curvatures of the combustion chamber walls well.

What is claimed is:

1. A ceramic lining for combustion chambers, comprising:

several juxtaposed ceramic elements that are attached by means of a retention bolt to the inside of a thermally highly stressed metallic support wall, wherein at least one insulation body is arranged between the metallic support wall and the ceramic elements, the ceramic elements essentially having the shape of a straight, regular pyramid whose base has at least three corners and faces the combustion chamber, and having a tip which is integrated with the retention bolt.

2. The ceramic lining as claimed in claim 1, wherein the ceramic elements form hollow spaces with their surfaces facing away from the combustion chamber, which hollow spaces are filled with insulation bodies that are form-fitting with the ceramic elements on the one side and the metallic support wall on the other side.

3. The ceramic lining as claimed in claim 1, wherein the ceramic elements form air-filled hollow spaces with their surfaces facing away from the combustion chamber.

4. The ceramic lining as claimed in claim 1, wherein the ceramic elements form a triangular base.

5. The ceramic lining as claimed in claim 4, wherein the ceramic elements essentially have the shape of a tetrahedron.

6. The ceramic lining as claimed in claim 1, wherein the insulation bodies are pressed by means of elastic elements against the ceramic elements.

7. The ceramic lining as claimed in claim 1, wherein the ceramic elements are pressed along with the insulation bodies against the metallic support wall via elastic elements, preferably plate springs, cylindrical pressure springs, or elastic sheet metal.

8. The ceramic lining as claimed in claim 1, wherein retention bolt of the ceramic element is elastically positioned.

9. The ceramic lining as claimed in claim 1, wherein the surfaces of the ceramic elements and of the insulation bodies have a convex or concave design.

10. The ceramic lining as claimed in claim 1, wherein the base of the ceramic elements is provided with thermal insulation layers or abrasion-resistant layers.

11. The ceramic lining as claimed in claim 6, wherein said elastic elements are selected from the group consisting of plate springs, cylindrical pressure springs, and elastic sheet metal.

* * * * *